United States Patent [19]

Oura et al.

[11] Patent Number: 4,748,817

[45] Date of Patent: Jun. 7, 1988

[54] METHOD AND APPARATUS FOR PRODUCING MICROFINE FROZEN PARTICLES

[75] Inventors: Hiroyuki Oura, Nara; Takeki Hata, Hyogo; Masuo Tada, Osaka, all of Japan

[73] Assignee: Taiyo Sanso Co., Ltd., Osaka, Japan

[21] Appl. No.: 72,507

[22] Filed: Jul. 13, 1987

[30] Foreign Application Priority Data

Oct. 6, 1986 [JP] Japan ..... 61-238695
Oct. 15, 1986 [JP] Japan ..... 61-244878

[51] Int. Cl.[4] ..... F25C 1/00

[52] U.S. Cl. ..... 62/74; 406/152; 406/153; 417/151; 62/116; 62/500

[58] Field of Search ..... 62/74, 70, 78, 64, 57, 62/116, 500; 417/151; 406/151, 152, 153

[56] References Cited

U.S. PATENT DOCUMENTS 3,024,117 3/1962 Barlow ..... 62/74
3,257,815 6/1966 Brocoff et al. ..... 62/57
3,313,032 4/1967 Malecki ..... 62/57
3,473,343 10/1969 Chamberlain ..... 62/7
3,564,861 2/1971 Anderson et al. ..... 62/50
3,646,177 2/1972 Thompson et al. ..... 264/28
3,655,838 4/1972 Price et al. ..... 264/28
4,077,227 3/1978 Larson ..... 62/74

*Primary Examiner*—Ronald C. Capossela
*Attorney, Agent, or Firm*—Griffin, Branigan & Butler

[57] ABSTRACT

A method for the production of microfine frozen particles comprises filling a vessel with a cold gas which may be a cooled gas or mixed gas obtainable by mechanical refrigeration of a refrigerant gas, air, or the like, atomizing a material to be frozen, such as water, into the cold gas so that the atomized particles become frozen by heat exchange with the cold gas, and collecting the fine frozen particles thus produced. An apparatus for carrying out the method comprises a heat-insulated vessel, a screen dividing the inside of the vessel into a region of cold gas phase and a region of cold gas source, an atomizer for atomizing a material to be frozen into the region of cold gas phase, and a means for filling the region of cold gas phase with a cold gas whether by generating a refrigerant gas by injecting nitrogen gas or the like into a refrigerant contained in the region of cold gas source, or by supplying a cool gas, such as mechanically refrigerated air, to the region of cold gas source, or by ejecting a refrigerant together with a cooled gas into the region of cold gas source, and apparatus for collecting frozen particles.

18 Claims, 5 Drawing Sheets

METHOD AND APPARATUS FOR PRODUCING MICROFINE FROZEN PARTICLES

FIELD OF THE INVENTION

This invention relates to a method and apparatus for the production of microfine frozen particles, such as fine ice particles, useful as an abrasive in surface treatments involving blasting, cleaning, or the like.

BACKGROUND OF THE INVENTION

A generally known method of producing microfine frozen particles, comprises atomizing the material to be frozen, such as water, into an insulated vessel containing a refrigerant, such as liquid nitrogen, so that the atomized particles of the material to be frozen, as they sink into the refrigerant, freeze by heat exchange with the refrigerant. In such a method, however, it is difficult to collect the frozen particles that have piled up in the refrigerant.

In an attempt to solve this problem Japanese Patent Publication No. 58-17392 proposes a method wherein the freezing of the liquid particles takes place, not in a refrigerant but, in the cold gas phase of the vaporized refrigerant. According to this method, there is provided a freezing vessel wherein a nozzle for atomizing the material to be frozen is placed at an upper position, a pair of tubes for spouting or spraying a refrigerant inwardly are placed on the interior wall of the vessel and near and below the nozzle, one tube higher than the other, and a scraper is placed at the bottom of the vessel. In practice a liquid material to be frozen, such as water, is atomized downwardly from the nozzle while a refrigerant, such as liquid nitrogen, is sprayed in a mist inwardly from the tubes. The atomized mist of the material to be frozen comes in contact with the sprayed refrigerant and its vaporized gas, some in flows that cross each other, some in parallel flows, and others in opposing flows. As the mist falls down it is frozen by heat exchange. The frozen particles pile up at the bottom of the vessel and are collected from the vessel by means of a scraper.

In a vessel designed as above, when the gasification of the refrigerant lowers the temperature of the cold gas phase to a certain degree or lower (for example, −60° C. or lower where liquid nitrogen is used as the refrigerant), it becomes possible for the sprayed refrigerant to fall to the bottom of the vessel in the liquid state without being vaporized. Where such a disorder is possible, it is necessary that the spraying tubes in the pair to be placed closer to the nozzle so that the sprayed refrigerant does not lower below a certain degree the temperature of its cold gas phase in the region within the reach of the sprayed liquid refrigerant. That is to say, the freezing vessel must be so designed that the particles, immediately after the atomization, pass through the region within the reach of the sprayed liquid refrigerant so as to accelerate the vaporization of the sprayed refrigerant by heat exchange with the particles from the atomization.

However, the contact of the atomized particles with the sprayed liquid refrigerant that takes place immediately after the atomization in a vessel arranged as described above makes it difficult for the particles to assume uniform globular shapes when frozen, because the, particles encounter the refrigerant before they assume globular shapes by surface tension. Deformed shapes, such as oval shapes, unavoidably result from such atomization. Moreover, agglomeration between the atomized particles is likely to occur as a result of their encountering the refrigerant and being frozen together and thus counteracting the effort to obtain frozen particles with uniform particle sizes. Needless to say, the frozen particles thus obtained are less than satisfactory as an abrasive for blasting, cleaning, etc.

SUMMARY OF THE INVENTION

An object of the present invention is to provide a method and apparatus for the production of microfine frozen particles by means of which frozen particles useful as an abrasive for blasting, cleaning, etc., can be produced with good reliability in uniform particle sizes and in the optimal globular shape.

Another object of the present invention is to provide a method and apparatus for the production of microfine frozen particles by means of which frozen particles can be produced and collected easily and satisfactorily, without lowering the hardness of the frozen particles, and without agglomeration between frozen particles.

Still another object of the present invention is to provide a method and apparatus for the production of microfine frozen particles whereby the energy consumption rate to produce the frozen particles can be reduced without losing efficiency and through this energy saving the production cost can be reduced considerably.

These objects and other objects of the invention are achieved by providing an apparatus comprising a vessel for producing frozen particles, wherein a refrigerant, such as liquid nitrogen, contained in the vessel is vaporized so as to fill the vessel space with the cold gas phase of the refrigerant, and into which a material to be frozen is atomized in such a manner as to make the atomized particles undergo heat exchange with the cold gas and then change into microfine frozen particles. The microfine frozen particles thus produced can be collected outside the vessel.

In accordance with the principles of the invention the apparatus includes a means for collecting frozen particles comprising a net-like structure, hereinafter called a "screen", which divides the inside of the vessel into a region of cold gas phase and a region of cold gas source; a means for vaporizing a refrigerant into a gas, such as gasification of liquid nitrogen, in the region of cold gas source; and a means for atomization placed near a cold gas exhaust which is at an upper position in the region of cold gas phase for atomizing a liquid material to be frozen, such as water, into the region of cold gas phase in such a manner as to freeze the atomized particles before they reach the screen by making them come into contact and undergo heat exchange with the vaporized refrigerant gas which is rising in the region of cold gas phase toward the cold gas exhaust after passing through the screen, toward the cold gas exhaust.

The refrigerant in the vaporized state is generated in the region of cold gas source, passes through the net-like structure into the region of cold gas phase, and rises through the latter-mentioned region toward the cold gas exhaust. The vaporized refrigerant undergoes heat exchange with the atomized particles of the material to be frozen and thereby assumes different densities gradually as it rises toward the cold gas exhaust.

On the other hand, the atomized particles fall naturally through the region of cold gas phase, gradually undergo heat exchange through contact with the vaporized refrigerant in opposing flows, and thus become frozen.

Since, the atomized particles become frozen where the refrigerant is in the vaporized state only, they can assume globular shapes by surface tension without interference as they become frozen. Since there is only a gradually rising flow of the refrigerant in the vaporized state it is impossible for there to be agglomeration between the particles. The frozen particles are formed separate from another and are produced with substantially uniform particle size.

The frozen particles thus formed fall onto a screen and are collected therefrom by a suitable apparatus. Since vaporized refrigerant passes through the screen in a rising flow, the frozen particles caught on the screen are kept cold and free from degradation in hardness and agglomeration with other particles at the time of collecting, all by virtue of the flowing vaporized refrigerant.

Another aspect of the present invention is the reduction in energy consumption rate required for the production of frozen particles. This is achieved by introducing a refrigerating system wherein a cooling gas, such as air, or a gas of nitrogen or argon, is cooled with a mechanical refrigerator and the cooled gas is supplied to the apparatus for producing frozen particles (hereinafter referred to as "freezing vessel") in such a manner as to fill the freezing vessel with the cold gas necessary for the freezing process, or in addition to supplying the freezing vessel with a cooled gas, a refrigerant, such as liquid nitrogen, is introduced into the freezing vessel in a jet of mist so as to fill the freezing vessel with a mixture of a cooled gas and a vaporized refrigerant.

In practice, such a refrigerating system, when only a oooled gas is supplied to the freezing vessel, comprises instead of a means for vaporizing a refrigerant as in the foregoing description, a means for supplying a cooled gas comprising a cooled gas supply pipe leading from a source of cooling gas to the region of cold gas source in the freezing vessel and a mechanical refrigerator for cooling the cooling gas in the cooled gas supply pipe. With respect to the temperature of the cold gas phase wherein the atomization and freezing take place, when, for example, water is made into ice particles, theoretically any temperature below 0° C. serves the purpose but practically it is preferable to adjust the temperature to a point in the range −60° C.−−13020 C., considering such related factors as the time of freeze and the capacity of the vessel.

In the practice of this invention a refrigerating system whereby the freezing vessel is cooled by both cooled gas and vaporized refrigerant is advantageously provided where the supply of a cooled (mechanically refrigerated) gas alone cannot lower the temperature of the cold gas phase in the freezing vessel adequately. The introduction of a mixture gas of a cooled gas and a vaporized refrigerant makes the temperature lower than a cooled gas alone. In such a system a spraying device is attached to the cooled gas supply pipe and a refrigerant mixed with the cooled gas is thereby sprayed, under the force of a jet-streaming cooled gas, into the region of cold gas source.

For the mechanical refrigeration a three way refrigerator is especially suitable. A refrigerating system wherein a refrigerant is used in conjunction with a cooling gas permits the refrigerator to have a lower capacity than if a cooling gas alone is used for the refrigeration. Where air is used as the cooling gas, it is advisable, as a preliminary step before the refrigeration, to pressurize the cooling air by a compressor and eliminate the moisture and carbon dioxide gas therefrom. This is because of the possibility that, as the cooling air becomes colder, moisture turns into ice and carbon dioxide into dry ice with the result that, for example, the cooled gas supply pipe is eventually blocked. For the elimination of moisture, a dehumidifier based on an absorbent such as synthetic zeolite or a reversing heat exchanger serves the purpose. To eliminate carbon dioxide gas, an apparatus based on an absorbent such as synthetic zeolite is applicable. Since, differing from water, carbon dioxide freezes into dry ice under partial pressure at a temperature in the range −140° C.−−150° C., it is not quite necessary to eliminate carbon dioxide where the temperature of the cooled gas is higher than that at which dry ice is formed. In a refrigerating system wherein a refrigerant is sprayed in a mixture with a cooled gas, even when the temperature of the cooled gas is higher than that at which dry ice is formed, carbon dioxide gas in the cooled gas may freeze under the influence of the refrigerant. When this is the case, it is advisable to mechanically arrange for the refrigerant and cooling gas to be mixed immediately before spraying, that is to say, at a point close to the spray head. In this way, dry ice that might accidentally form will be of such a small size that it causes virtually no problems such as the blocking referred to above. In cases where the frozen particles produced are required to be especially clean, such as those for the surface-treatment of semiconductors, it is advisable to supply the freezing vessel with the cooled gas which has been purified by a high-efficiency filter, such as membrane filter. It is advisable also to likewise purify the gas for atomizing the material to be frozen in such cases.

Other objects, features, aspects and advantages of the present invention will become apparent upon consideration of the following detailed description of the invention when taken in conjunction with the accompanying drawings.

DESCRIPTION OF A PREFERRED EMBODIMENT

Figure 1:
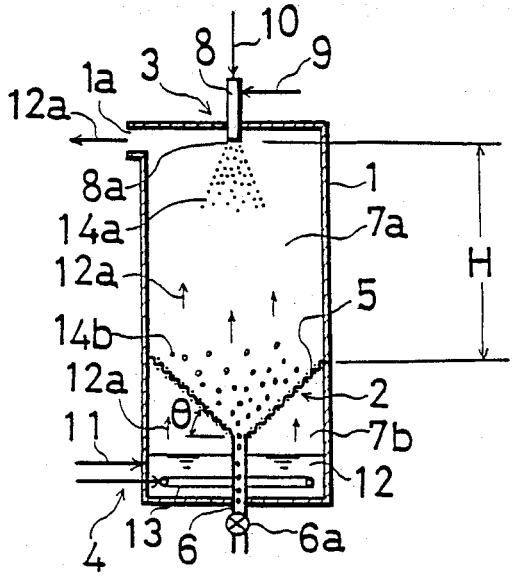
FIG. 1 is a schematic cross-section view of an apparatus constructed in accordance with the principles of the present invention.
Figure 3:
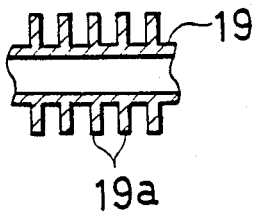
FIG. 3 is a cross-sectional representation of a suitable drive gas conduit.

FIG. 1 illustrates a preferred embodiment of the invention wherein an apparatus for producing microfine frozen particles comprises a freezing vessel 1, a means for collecting frozen particles 2, an atomizer 3, and a means for vaporizing refrigerant 4.

The freezing vessel 1 comprises a heat-insulated closed vessel whose horizontal cutaway section is square with each side measuring 400 mm. The vessel 1 has a cold gas exhaust outlet 1*a* at the top of one side.

The means 2 for collecting frozen particles comprises a screen 5 whose sides narrow toward the lower end in a pyramidal shape so as to funnel or direct frozen particles into a collecting pipe 6 which extends upwardly through the bottom of the vessel at the center thereof. The screen 5 is fixed (by means not shown) to the freezing vessel 1 at positions on its interior side and divides the interior space into an upper region which constitutes the region of cold gas phase 7*a* and a lower region which constitutes the region of refrigerant gas generation 7*b*. The screen 5 is of a material which is resistant to cold and may comprise a metal net screen with a mesh or holes through which only the refrigerant gas is permitted to flow (for example, 150 mesh Japan Industrial Type SUS304). The lower end of the frozen particle collecting pipe 6 extends out through the bottom of vessel 1 and is connected to a frozen particle collecting valve 6*a*, such as a rotary valve. The angle $\theta$ which the screen 5 forms with a horizontal plane can be set with the quantity of the refrigerant gas, size of the frozen particles, etc. as variable factors and depending on whether a scraper is used or not. When a scraper is not used, the standard degree of this angle is about 45°.

The atomizer 3 comprises an atomizer proper 8 which is attached to the central top side of the freezing vessel 1 and connected with a material feeding pipe 9 for feeding a liquid material to be frozen, such as water, and also with an atomizing gas conduit 10 for drawing in an adequately pressurized and cooled atomizing gas such as nitrogen gas. A material to be frozen, such as water, is atomized downwardly through the nozzle 8*a* at the tip of the atomizer 8 under the pressure of the atomizing gas. The size of the droplets (atomized particles) 14*a* can be adjusted by controlling the nozzle hole diameter and atomizing pressure. The materials which may be atomized, besides water, include various other liquids provided that the material suits heat exchange with the refrigerant gas in freezing.

The means 4 for vaporizing refrigerant is supplied with a refrigerant 12, such as liquid nitrogen, through a refrigerant supply pipe 11, and holds a quantity of the refrigerant 12 in the vessel defined by the region of refrigerant gas generation 7*b*. The refrigerant 12 is made to vaporize into a gas 12*a* by injection of a bubbling gas, such as dried air, nitrogen or argon, into said refrigerant through a bubbling tube 13.

The apparatus described above operates as follows. A vaporized refrigerant 12*a* rises from the region of refrigeration gas generation 7*b*, and passes through the screen 5 and into the region of cold gas phase 7*a* toward the cold gas exhaust outlet 1*a*. The vaporized refrigerant 12*a* undergoes heat exchange with the atomized material to be frozen, i.e., droplets in mist 14*a*, and thereby assumes different (lower) densities as it rises toward the cold gas exhaust outlet 1*a*. The liquid droplets 14*a*, after atomization, fall naturally through the region of cold gas phase 7*a* and freeze by gradual heat exchange as they contact the rising vaporized refrigerant 12*a* in opposing flows. When the screen 5 is inclined so as to dispense with a scraper, frozen particles 14*b* are collected without piling up on the screen 5.

Figure 8:
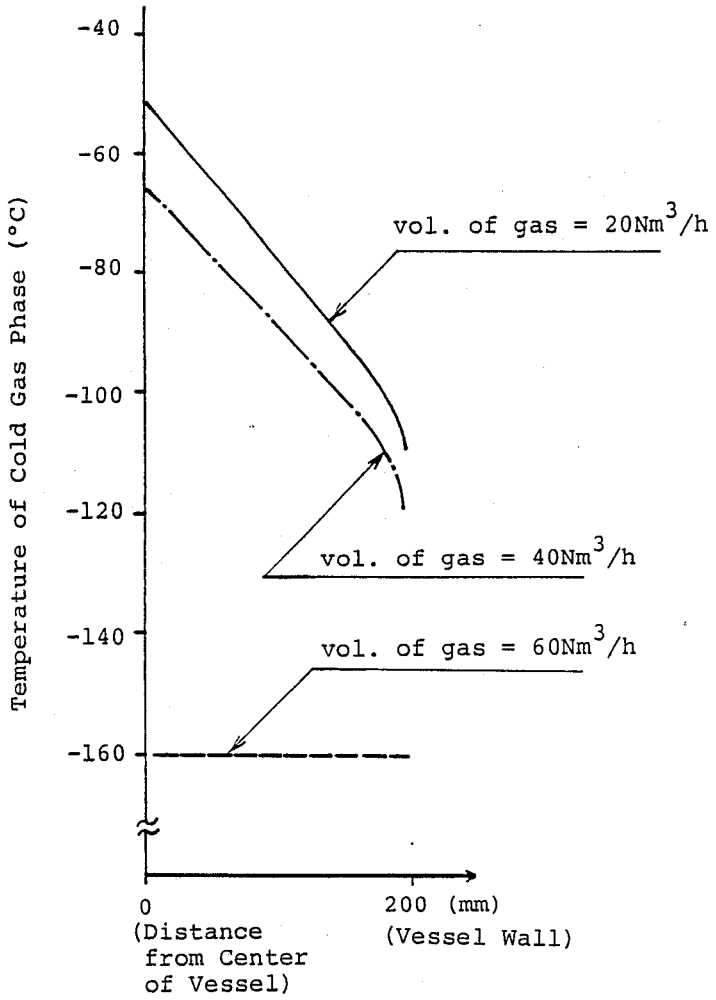
FIG. 8 is a diagram showing the correlation between the temperature distribution of the cold gas phase and the generation of the refrigerant gas for one embodiment.

Through experiments with the above-described apparatus the inventors in the present application discovered that, when water is atomized from the nozzle 8*a* at the rate of 0.2 l/min (12 l/h), the average temperature of the cold gas phase at a lower position in the region 7*a*, that is, at a position close to the screen 5 in the region of cold gas phase, ranges below −80° C. with water atomized above and that, when the diameter of the atomized water droplets 14*a* is 300 microns or less and water is atomized with a pressure of 4 kg/cm$^2$ or less, the height H between the nozzle 8*a* and the screen 5, which represents the effective height of the cold gas phase 7*a*, may be reduced to 1 m or so and the apparatus will still produce ice particles 14*b* of good quality. As shown in FIG. 8, the temperature of the cold gas phase has a close correlation with the generation of the refrigerant gas 12*a*. In the diagram the temperature distribution at a plane across the region of cold gas phase 7*a* is shown for each of three different values of the generation of the gas of liquid nitrogen 12, i.e., 20 Nm$^3$/h, 40 Nm$^3$/h, and 60 Nm$^3$/h, against atomization of water at 0.2 l/min. From this diagram it follows that, given the area of a plane horizontally cutting the cold gas phase as 0.16 m$^2$, the rate of water atomized as 0.2 l/min (12 l/h), and the particle size of water atomized as 300 microns or less, the refrigerant gas is required to be generated at 40 Nm$^3$/h or more for an average cold gas phase temperature of −80° C. or lower. The distance of fall that the atomized particles require for freezing into microfine frozen particles is approximately one meter.

The effectiveness of a short distance of approximately one meter as the height H in the region of cold gas phase permits the freezing vessel 1, or practically the entire apparatus to be made on a very small scale. The atomizer may atomize downwardly when the pressure of atomization is low or the diameter of the atomized particles, or the size of the frozen particles, is small. However, the freezing vessel 1 must be large when the direction of atomization is downward and the the pressure of atomization is high or the size of the frozen particles is large. This is due to the need to allow the atomized particles 14*a* and the refrigerant gas 12*a* a sufficient time for contact and heat transfer between the two. In this case it is advantageous to have the atomization in the horizontal direction. This will allow sufficient time of contact between the atomized particles and refrigerant without the need to enlarge the freezing vessel 1.

Ice particles 14*b* on the screen 5 move along the downward slope of the screen and by the action of the refrigerant gas 12*a* passing upward through the screen 5 and are eventually collected through the collecting pipe 6. The collected ice particles are drawn out of the apparatus 1 by the action of the collecting valve 6*a* and used for blasting etc. The formation of frozen particles from atomized water is influenced by the quantity of water atomized, the temperature of the cold gas phase, the rate of generation of the refrigerant gas, the particle size, the speed of fall of the frozen particles, and the time of contact between the frozen particles and the cold gas. Experiments and tests will easily provide the appropriate values of these factors to technicians who need them.

Even though the collection of ice particles in the collecting pipe 6 is influenced by the angle $\theta$ formed by the screen 5 with a horizontal plane, the temperature of the upper side of the screen 5, the rate at which the refrigerant gas 12*a* passes through the screen 5, and the particle size of the ice particles 14b, collection can be improved, regardless of the various influencing factors, by giving the screen a vibrating or shaking motion continuously or intermittently by means of a device such as a vibrator.

Figure 2:
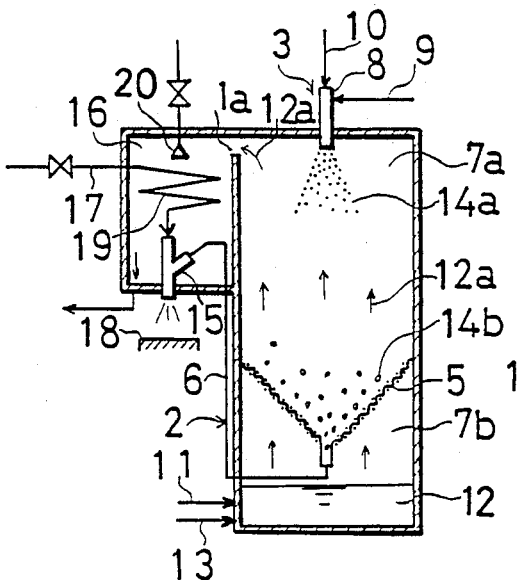
FIG. 2 is a schematic cross-sectional view of a second embodiment including an ejector for ejecting frozen particles.

It is also paractical to supply the ice praticles 14b directly to a frozen particles ejector 15 provided outside the freezing vessel 1, as shown in FIGS. 2, 3, 5, 6 and 7. Referring to FIG. 2, there is shown schematically an apparatus with a frozen particles ejector 15, wherein an exhaust heat recovery chamber 16 is placed adjoining to and at an upper part of the freezing vessel 1 with a cold gas exhaust outlet 1a opened between the chamber and vessel. The exhaust heat recovery chamber 16 is provided with a frozen particles ejector 15 at the bottom. A frozen particles-collecting pipe 6 and a drive gas conduit 17 are connected to the frozen particles ejector 15, and when a drive gas is fed into the ejector 15 through the conduit 17, the drive gas exercises an ejector effect so that the frozen particles 14b are drawn to the ejector 15 through the collecting pipe 6 and then ejected onto the surface of an object 18 which is to be treated. The part 19 of the drive gas conduit 17 is designed to function as a heat exchanger. The drive gas is cooled by its heat exchange with the refrigerant gas 12a which is brought through the cold gas exhaust outlet 1a into the exhaust heat recovery chamber 16. The part 19 may be made of a thick pipe material with many radial fins 19a (FIG. 3) and it may be laid in the form of a coil so as to widen the area of heat transfer with the refrigerant gas 12a as well as to impart a heat accumulation effect thereto. A copper alloy or the like having a high thermal conductivity is suitable as the material for the part 19.

By providing a frozen particles collecting means as described above the drive gas can be cooled sufficiently to prevent lowered hardness and agglomeration of frozen particles 14b without an additional cooling means. When the refrigerant gas 12a is not generated in an intermittent operating schedule, the heat accumulating effect keeps the drive gas cool. The drive gas can thus be cooled to a temperature close to that of the refrigerant gas 12a exhausted from the freezing vessel 1, but when it is required to cool the drive gas further, it is practical to atomize a refrigerant such as liquid nitrogen toward the drive gas conduit 19 from a refrigerant atomizing nozzle 20 at the top of the exhaust heat recovery chamber 16.

Figure 4:
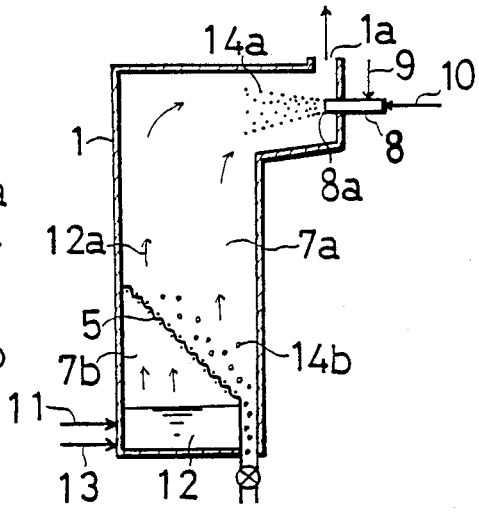
FIGS. 4 through 7 are cross-sectional views illustrating different forms of a frozen particle collection apparatus.
Figure 5:
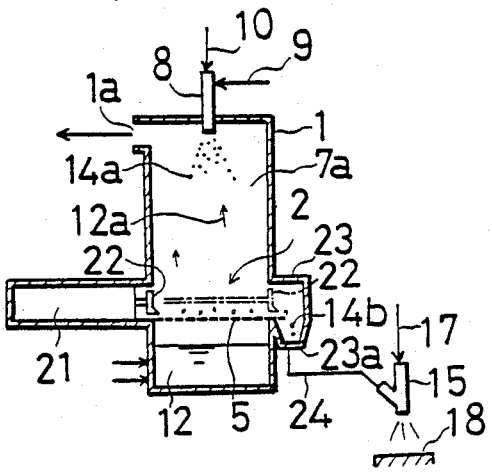
Figure 6:
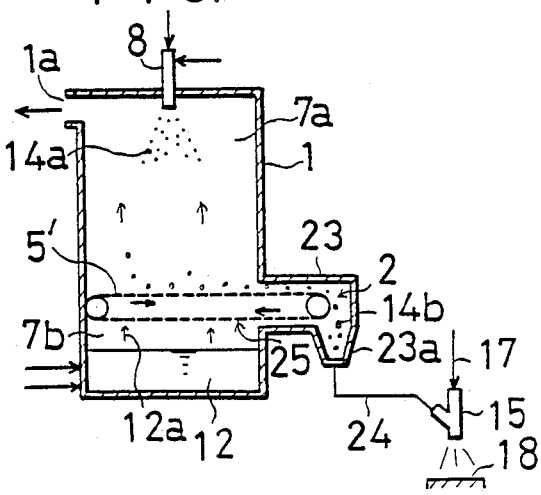

The screen 5, unlike the inclined screens as shown in FIGS. 1, 2 and 4, can be set horizontally as shown in FIG. 5 so that the frozen particles 14a piling up on the screen can be removed therefrom by a scraper 22, moved back and forth by a cylinder 21 or the like, and collected in a hopper 23a of the frozen particles recovery chamber 23. The frozen particles 14b collected in the hopper 23a are drawn through a supply pipe 24 into an ejector 15 under the force of a drive gas supplied through a conduit 17 and ejected onto the surface an object 18 being treated.

Figure 7:
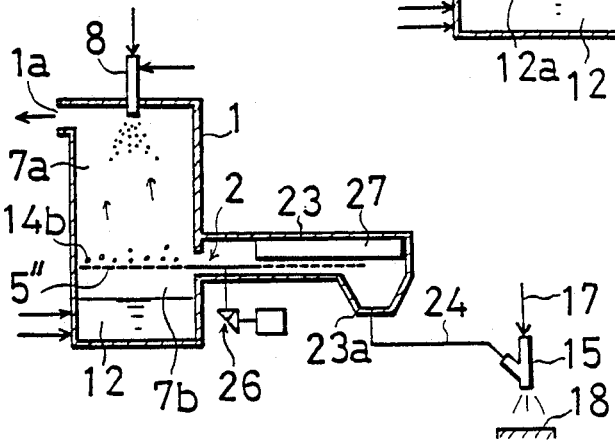

The means 2 for collecting frozen particles can be so designed that the screen 5 inside the freezing vessel can be brought out of the freezing vessel for collection of the particles. For example, one such means comprises (FIG. 6) an endless mesh belt 5' as the screen which functions as a conveyor belt 25 and divides the inside of the freezing vessel into an upper region 7a and a lower region 7b. One end of the conveyor belt extends into a frozen particles recovery chamber 23 so that frozen particles 14b accumulating on the mesh belt 5', as they come to the turning end of the conveyor belt in the frozen particles recovery chamber, are collected into a hopper 23a therein. Also, as shown in FIG. 7, the screen can be a horizontally rotating plane 5'' driven by a drive mechanism 26. A scraper 27 scrapes frozen particles from the rotating screen into the hopper 23a.

Since the atomized particles 14a to be frozen are made to freeze by heat exchange with only a vaporized refrigerant 12a in the cold gas phase in the practice of the present invention, they are free from the striking action of the liquid refrigerant which would cause irregularity in the preferred globular shape of the frozen particles as well as inappropriate dispersion. The method and apparatus provided by the present invention make it certain that microfine frozen particles 14b with uniform particle sizes and globular shapes optimal for abrasives in blasting, cleaning, etc. are obtained. The frozen particles 14b lying on the screen 5, 5' or 5'' are kept frozen and in motion by the refrigerant gas 12a so that the production of frozen particles can be carried out with ease, and without the problems of lowered hardness or agglomeration between particles.

Compared with conventional methods, a large reduction in the use of refrigerant, or specifically a reduction in energy consumption rate in the production of frozen particles, can be realized by the method and apparatus described above. In addition, a considerable further reduction in energy consumption rate can be achieved when, as shown in FIGS. 9 and 10, a cooled gas-supplying means is provided instead of the refrigerant gas generating means 4 so as to fill the region of cold gas phase 7a with only the cooled gas or a mixture of the cooled gas and a refrigerant gas.

Figure 9:
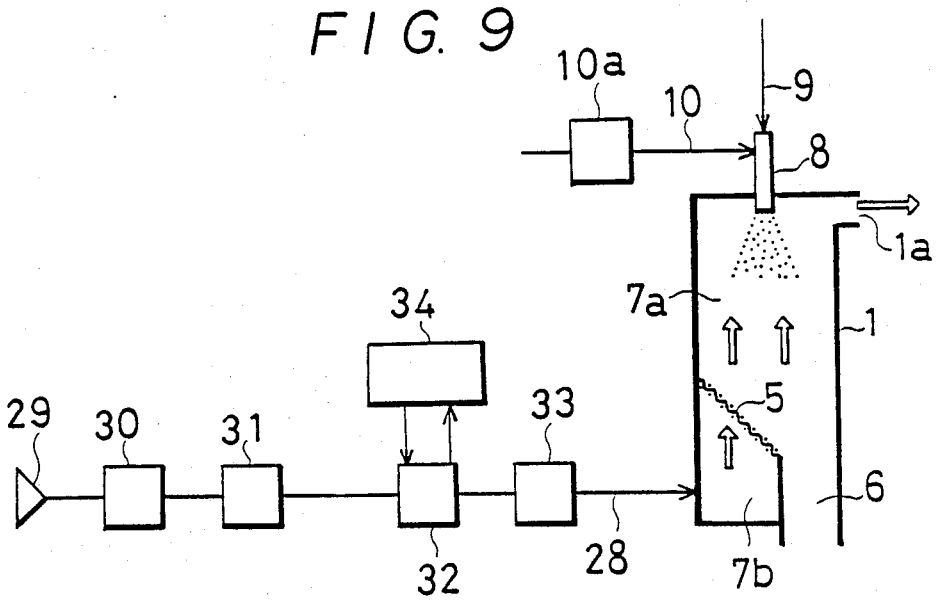
FIG. 9 is a flow diagram of a cooled gas supply system.
Figure 10:
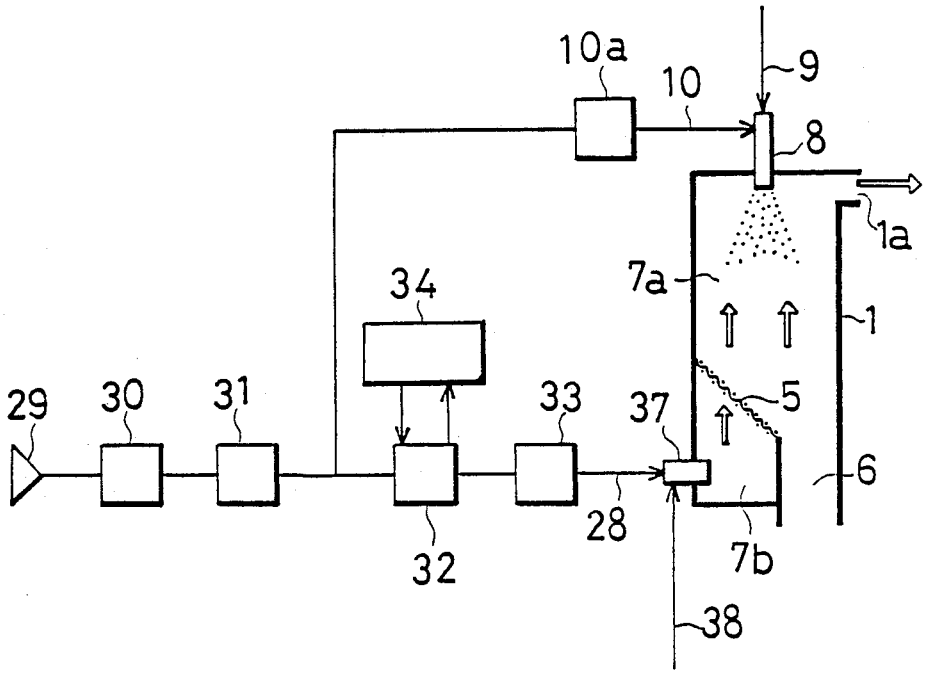

Referring to FIG. 9, there is shown a cooling gas supply system wherein a cooled gas supply pipe 28 extends from a cooling gas source 29 to the lower chamber 7b of a freezing vessel 1. The vessel may be a heat-insulated closed vessel with a circular horizontal section having an inner diameter of 400 mm and a height of approximately 1500 mm. The cooled gas supply pipe 28 is equipped with a compressor 30, a moisture remover 31, a heat exchanger 32, and filter 33, which all are arranged in a direct single line from the cooling gas source 29. In one test a compressor 30 having a capacity of 92 $NM^3/h$, which can pressurize the cooling gas up to 5 Kg/cm, was used. For the moisture remover 31, a dehumidifier of the pressure variable type, based on synthetic zeolite as the absorbent, was used. The heat exchanger 32 used was of the fin-aided type (refrigerant vaporizing temperature −80° C., heat exchanging capacity 2,500 Kcal/h), which was designed to cool the cooling gas by heat exchange with a refrigerant (R-12) circulated between the heat exchanger 32 and a refrigerator 34. The refrigerator 34 used had a refrigeration capacity of 2,500 Kcal/h and a shaft power of 5 KWh. For the filter 33, a membrane filter (screening ability 0.1 micron) was used. A similar filter 10a was used in the atomization gas conduit 10.

Figure 9A:
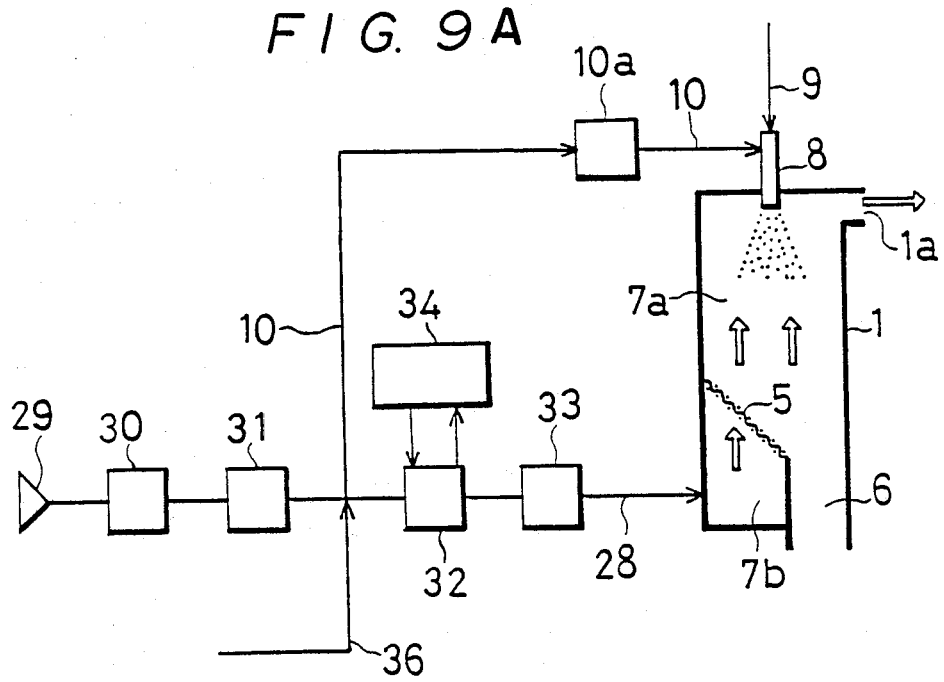
FIG. 9A is a flow diagram showing an alternative form of a cooled gas supply system; and, FIG. 10 is a flow diagram of a cooled gas supply system including an ejector.

With water as the material to be frozen and air as the cooling gas in this particular example air (20° C.) as the cooling gas is passed through compressor 30, moisture remover 31, heat exchanger 32, and filter 33 and supplied from the supply pipe 28 into the region of cold gas source 7b in the freezing vessel 1. To be more specific, the air taken in from the cooling gas source 29 is pressurized up to 5 $Kg/cm_2$ by compressor 30, cooled to −80° C. in the heat exchanger 32 by heat exchange with the refrigerant from the refrigerator 34, then purified by the filter 33 and fed into the lower chamber of the freezing vessel 1. The cooled air is supplied at a flow rate of 80 $NM^3/h$. When a gas of nitrogen, argon or the like is used instead of air for to cooling, the cooling gas supply system does not require the compressor 30 and the moisture remover 31. When the manufacturing plant producing frozen particles is equipped with a dry air supply system, the dry air obtainable therefrom can be utilized for the cooling gas. For example, as shown in FIG. 9A, a dry air line 36 is connected with the cooling gas supply pipe 28. Water to be frozen is atomized from the atomizer 8 when the cooled air sent into the region of cold gas source 7b has passed through the screen 5 and fills the region of cold gas phase 7a. To be more specific, water is supplied to the atomizer 8 at the rate of 10 together with the supply of nitrogen gas for atomization at the rate of 1 Nl/h so that the water is atomized downward into the cold gas in the freezing vessel with a force of 2.6 $Kg/cm^2$.

When the same gas is used for atomization as well as the cooling (e.g., air is used as both the cooling gas and the atomization gas), as shown in FIG. 9A, the gas conduit 10 is connected with the cooling gas supply pipe 28 so as to supply part of the cooling gas (e.g., dry air obtainable after the dehumidification) to the atomizer.

With the apparatus designed as above the cooled air gradually rises toward the cold gas exhaust outlet 1a as it undergoes a change in density as the result of heat exchange with the water droplets formed by atomization. The water droplets formed by the atomization falls naturally through the cold gas in the upper chamber 7a and freeze during their descent by heat exchange with the rising cooled air. The ice (frozen) particles caught on the screen 5 are collected through a frozen particles-collecting outlet 6.

In the test ice particles having a temperature of −70° C. and particle sizes in the range 100–200 microns were produced at the rate of 10 Kg/h.

The cooled gas supply means shown in FIG. 10 is equipped with a compressor 30, heat exchanger 32, and refrigerator 34, each of which is lower in capacity than those referred to above, and moreover, with an ejector 37 by means of which a mixture of cooled gas and liquid nitrogen as a refrigerant is ejected. The ejector 37, having its nozzle opened toward the region of cold gas source 7b in the freezing vessel 1, is connected with the cooled gas supply pipe 28 and a refrigerant supply pipe 38 so that cooled gas and refrigerant are mixed at a position close to the nozzle and the refrigerant is ejected as a mist into the region of cold gas source 7b under the ejecting pressure of the cooled gas. The compressor 30 has a capacity of 35 $NM^3/h$ for a pressure of 5 $Kg/cm^3$, the heat exchanger 32 a capacity of 800 Kcal/h for a refrigerant vaporizing temperature of −85° C. with fins, and the refrigerator 34 a capacity of 800 Kcal/h and a shaft power of 1.6 KWh.

The apparatus of FIG. 10 is operated as follows where water is atomized into frozen particles, air is used as the cooling gas, and liquid nitrogen is used as the refrigerant. First, air (20° C.) for cooling is pressurized up to 5 $Kg/cm^2$ with compressor 30 and cooled to −80° C. by means of the heat exchanger 32 and the refrigerator 34. The cooled air is purified by the filter 33 and supplied to the ejector 37, while liquid nitrogen (−196° C.) is supplied through pipe 38 to the ejector 37 at the rate of 10 $NM^3/h$. The liquid nitrogen is ejected together with the cooled air into the region of cold gas source 17b in the form of mist. At this time the cooled air is supplied at the rate of 30 $NM^3/h$ and the liquid nitrogen is supplied at the rate of 10 $NM^3/h$ The compressor 30 and the moisture remover 31 are not required if the cooling gas is nitrogen, argon, or the like instead of air. If the manufacturing plant is equipped with a dry air supply system, the dry air can be utilized as the cooling gas and/or the atomizing gas.

The water to be frozen is atomized from the atomizer 8 when the mixture (−160° C.) of the cooled gas and the ejected vaporized refrigerant passes through the screen 5 and the cold gas has filled the region of cold gas phase 7a. To be more specific, while water is supplied to the atomizer 8 at the rate of 10 l/h, the atomizing gas is supplied thereto at the rate of 1 N l/h, and the water is atomized downward into the cold gas phase with a pressure of 2.5 $Kg/cm^2$. The cooling gas supply pipe 28 is connected with the conduit 10 of the atomizing gas so as to utilize dehumidified dry air which constitutes part of the cooling gas.

With the method and the apparatus set forth above ice particles having a temperature of −130° C. (particle sizes 100–200 microns) were obtained at the rate of 10 Kg/h.

Thus, when a cold gas such as air cooled by mechanical refrigeration or a mixture of such a gas with a refrigerant is used as the freezing gas, the production of frozen particles can dispense with the refrigerant or requires only a very small amount of it and so the energy consumption rate is reduced.

Although it is possible to produce frozen particles having a temperature in the range −50° C. to −100° C. by the method using cold gas as shown in FIG. 9, the energy consumption rate required in this system may e calculated by assuming that the cold gas phase energy required in producing 1 Kg of ice particles with a temperature of −80° C. is approximately 125 Kcal. When air (20° C.) is taken in as the cooling gas, the energy consumption rate becomes 1.13 Kw/Kg. ice for a cooled gas temperature of −85° C. The production of 1 Kg of 5 ice particles requires 7.58 $Nm^3$ cooled gas, which can be obtained by a compressor pressurizing energy of 7.58 ×1.15 (yield)×0.1 =0.87 KW. The electric energy required to cool air of 20° C. (7.58 $Nm^3$) to −85° C. with a refrigerator (two step refrigerator) is calculated as follows:

$$Q=7.58\times1.25\times0.24\times100=227.4 \text{ Kcal}$$

$$227.4/860=0.26 \text{ KW}$$

Accordingly, 0.87+0.26=1.13 KW/Kg. ice is the total energy consumption rate required.

The energy consumption rate becomes 0.69 KW/Kg.ice for a cooled gas temperature of −130° C. The cooled gas required for 1 Kg ice particles is 4.17 $Nm^3$, which can be obtained by a compressor pressurizing energy of 4.17×1.15 (yield)×0.1=0.48 KW. The electric energy required to cool air of 20° C. (4.17 $Nm^3$) to 130° C. with a refrigerator (three way refrigerator) is calculated as follows:

$$Q=187.5 \text{ Kcal or } 187.5/860=0.21 \text{ KW.}$$

The total energy consumption rate is 0.48+0.21=0.69 KW/Kg. ice.

On the other hand, the energy consumption rate required becomes 5.25 KW/Kg.ice when a refrigerant is introduced in a system as shown in FIG. 1, all other conditions being the same. Specifically, given the temperature of the refrigerant gas as −150° C., the liquid nitrogen (and nitrogen gas injected into it) required as the refrigerant is approximately 3.5 $Nm^3$/kg.ice. Since the energy consumption rate is approximately 1.5 KW/$Nm^3$ when liquid nitrogen is produced, the energy consumption rate, i.e., the electric energy required, is obtained as $3.5\times1.5=5.25$ KW/Kg.ice.

Thus a sharp reduction to one-seventh in energy consumption rate can be realized when the system has been switched from the refrigerant gas method to the cooled gas method.

The mixed gas method, as shown in FIG. 10, is capable of producing frozen particles of a temperature in the range −50° C.--100° C. as in the case of a cooled gas system. The energy consumption rate required in such a system is calculated as 1.9 KW/Kg.ice when the mixed gas is obtained by mixing cooled air of −80° C. (2.95 $Nm^3$, taken in at 20° C.) as the cooled gas with liquid nitrogen (0.95 $Nm^3$) as the refrigerant having a temperature of −150° C., and assuming that the cold gas phase energy required in producing 1 Kg of ice particles of −130° C. is approximately 140 Kcal. To be more specific, the pressurizing energy of the compressor for obtaining 2.95 $Nm^3$ air is:

$$2.95\times1.15\times0.1=0.339 \text{ KW}$$

The electric energy required to cool air of 20° C. (2.95 $Nm^3$) to −80° C. with a refrigerator is:

$$Q=2.95\times1.25\times0.24\times100=88.5 \text{ Kcal}$$

or $$88.5/860=0.103 \text{ KW}$$

Since the energy consumption rate for the production of 0.95 $Nm^3$ liquid nitrogen is 1.5 KW/$Nm^3$, the energy consumption rate required is $0.95\times1.5=1.43$ KW. Therefore, $0.339+0.103+1.43=1.872$ KW/Kg.ice is the total energy consumption rate required.

The energy consumption rate required in the use of the refrigerant gas system mentioned above under the same conditions is $3.9\times1.5=5.85$ KW/Kg.ice, given the temperature of the refrigerant gas as −150° C., since liquid nitrogen as refrigerant (and the nitrogen gas injected into it) is required at the rate of 3.9 $Nm^3$/Kg.ice.

Thus a reduction to one-third in the energy consumption rate is possible with the mixed gas system as compared to the refrigerant gas system, the use of the refrigerant increasing the energy consumption rate somewhat over that for the system of cooled gas alone.

Obvious changes may be made in the specific embodiments of the invention described herein, such modifications being within the spirit and scope of the invention claimed as defined by the appended claims. Furthermore, specific examples set forth herein are by way of illstration only and are not intended as limits on the scope of the invention.

The embodiments of the invention in which an exclusive property or privilege are claimed are defined as follows:

1. A method for the production of microfine frozen particles wherein, while a cooling gas of air, nitrogen, argon or the like is cooled by mechanical refrigeration and then supplied to the inside of a production vessel, a refrigerant such as liquid nitrogen is ejected in the form of mist into said vessel in such a manner as to fill the vessel with a mixed gas of said cooled gas and vaporized refrigerant; atomizing particles a material to be frozen into the vessel so that the atomized particles are frozen by heat exchange with said mixed gas; and collecting the frozen particles.

2. A method for the production of microfine frozen particles as claimed in claim 1, wherein dehumidified dry air is used as said cooling gas.

3. A method for the production of microfine frozen particles as claimed in claim 2, wherein dry air from which carbon dioxide gas as well as moisture have been removed is used as said cooling gas.

4. A method for the production of microfine frozen particles as claimed in claim 1, wherein said cooling gas is filtered before it is supplied to the inside of said vessel.

5. A method for the production of microfine frozen particles as claimed in claim 1, wherein the refrigerant is mixed with said cooled gas by means of an ejector before being ejected into the vessel under the ejecting force of said cooled gas.

6. A method for the production of microfine frozen particles as claimed in claim 5, wherein said refrigerant and said cooled gas are mixed together immediately before the mixture is ejected from said ejecting means.

7. A method for the production of microfine frozen particles as claimed in claim 1, wherein said cooling gas is a gas from the group comprising air, nitrogen and argon.

8. An apparatus for the production of microfine frozen particles said apparatus comprising:

a production vessel;

means for collecting frozen particles including a screen which divides the inside of said production vessel into a region of cold gas phase and a region of cold gas source;

means for generating a refrigerant gas which vaporizes a refrigerant such as liquid nitrogen in the region of cold gas source; and an atomizer positioned close to a cold gas exhaust outlet at the top of the region of cold gas phase said atomizer atomizing into particles a liquid material to be frozen, such as water, into the region of cold gas phase;

said refrigerant gas rising through said screen toward said cold gas exhaust outlet and undergoing heat exchange with said material atomized in particles as they come into contact in the region of cold gas phase so that the atomized particles become frozen before they reach said screen.

9. An apparatus for the production of microfine frozen particles as claimed in claim 8, wherein said means for collecting frozen particles includes said screen which comprises of a metal net or the like inclined downwardly and a frozen particles collecting pipe connected with said screen at its lower part.

10. An apparatus for the production of microfine frozen particles as claimed in claim 9, wherein said means for collecting frozen particles includes means for vibrating said screen.

11. An apparatus for the production of microfine frozen particles as claimed in claim 8, wherein a portion of said screen is placed inside said vessel and can be moved out of the vessel.

12. An apparatus for the production of microfine frozen particles as claimed in claim 8, wherein said means for generating a refrigerant gas vaporizes a refrigerant by injecting dry air, or a gas of nitrogen or argon into liquid nitrogen contained in the region of cold gas source.

13. An apparatus for the production of microfine frozen particles, said apparatus comprising a production vessel;

means for collecting frozen particles including a screen which divides the production vessel into a region of cold gas phase and a region of cold gas source;

means for supplying a cooled gas including:

a cooling gas supply pipe which extends from a source of cooling gas to the region of cold gas source, and a mechanical refrigerator for cooling the cooling gas in said cooling gas supply pipe; and, means positioned close to a cold gas exhaust outlet at the top of the region of cold gas phase for atomizing particles of a liquid material to be frozen, such as water, into the region of cold gas phase;

said cooled gas rising through said screen toward said cold gas exhaust outlet and undergoing heat exchange with said atomized particles as they come into contact in the region of cold gas phase whereby the atomized particles are frozen before they reach said screen.

14. An apparatus for the production of microfine frozen particles as claimed in claim 13, wherein said cooled gas supply means includes an ejector for the cooled gas supply pipe so that a refrigerant can be ejected into the region of cold gas source together with the cooled gas and under its force.

15. An apparatus for the production of microfine frozen particles as claimed in claim 13, wherein said cooled gas supply means includes a filter for the cooled gas supply pipe.

16. An apparatus for the production of microfine frozen particles as claimed in claims 13, wherein said cooling gas supply means includes a dehumidifier for the gas supply pipe.

17. An apparatus for the production of microfine frozen particles as claimed in claim 14, wherein said cooled gas supply means includes a filter for the cooled gas supply pipe.

18. An apparatus for the production of microfine frozen particles as claimed in claims 14, wherein said cooling gas supply means includes a dehumidifier for the gas supply pipe.

* * * * *